United States Patent [19]

Yasui et al.

[11] Patent Number: 4,758,106

[45] Date of Patent: Jul. 19, 1988

[54] BIDIRECTIONAL PRINTER WITH VOLTAGE COMPENSATOR

[75] Inventors: Tsuneo Yasui, Nagoya; Yoshiharu Hirai, Anjo, both of Japan

[73] Assignee: Brother Industries, Ltd., Nagoya, Japan

[21] Appl. No.: 33,054

[22] Filed: Apr. 1, 1987

Related U.S. Application Data

[63] Continuation of Ser. No. 737,230, May 23, 1985, abandoned.

[30] Foreign Application Priority Data

Jun. 4, 1984 [JP] Japan ..... 59-114039

[51] Int. Cl.[4] ..... B41J 19/30

[52] U.S. Cl. ..... 400/323; 400/322; 400/88

[58] Field of Search ..... 400/54, 74, 88, 323, 400/323.1, 166, 303, 320, 322; 101/93.03

[56] References Cited

U.S. PATENT DOCUMENTS 3,344,899 10/1967 Wang et al. ..... 400/54
4,210,404 7/1980 Hanger ..... 400/124
4,407,003 9/1983 Fukui ..... 400/120

OTHER PUBLICATIONS

Centronics Model 351 Technical Manual; Jun. 1983; pp. 4–6, 4–7, 4–8.

*Primary Examiner*—David Wiecking
*Attorney, Agent, or Firm*—Kane, Dalsimer, Sullivan, Kurucz, Levy, Eisele and Richard

[57] ABSTRACT

A battery powered serial printer having a print head for printing data on a printing sheet in a normal direction from the beginning of a line or in the reverse direction from the end of a line includes a drive unit for moving the print head in reciprocatory movement in the normal and reverse directions, and a device for judging whether the print head is printing characters in the normal direction or in the reverse direction. The serial printer further includes a correcting device responsive to voltage changes for delaying the initiation of the operation of printing characters by the print head at the least in either the normal direction and/or the reverse direction judged by the judging device, so as to bring the positions of characters printed in the normal direction into alignment with the positions of characters printed in the reverse direction.

3 Claims, 4 Drawing Sheets

BIDIRECTIONAL PRINTER WITH VOLTAGE COMPENSATOR

This is a continuation of co-pending application Ser. No. 737,230 filed on May 23, 1985, now abandoned.

BACKGROUND OF THE INVENTION (1) Field of the Invention

This invention relates to printers, and more particularly it is concerned with a serial printer suitable for use in printing data on a printing sheet by moving a print head in reciprocatory movement along a line on which characters, symbols, etc., are to be printed, so as to perform printing by moving the print head in a normal direction from the beginning of the line or in the reverse direction from the end of the line.

(2) Description of the Prior Art

In this type of serial printer of the prior art, it is the customary practice to move the the print head in reciprocatory movement by a drive unit comprising a step motor as an electric current is passed thereto so as to perform printing both in the normal direction and the reverse direction. The pulse motor rotates at a predetermined speed when a steady-state current of a predetermined voltage is supplied to the drive unit from a battery serving as a power source, to thereby move the print had at a predetermined speed. However, this type of serial printer suffers the following disadvantage. When the voltage supplied to the drive unit drops due probably to a reduction in the electrical charge in the battery, the magnetic force of the stator of the pulse motor decreases and the response of the rotor becomes poor, with the result that the speed of movement of the print head drops below the predetermined level. This causes a variation to occur in the distance covered by the movement of the print head when it performs a printing operation, so that the characters printed by the print head moving in the normal and reverse directions are brought out of alignment with each other.

In view of the disadvantage of the prior art noted hereinabove, it has until now been desired that a serial printer be provided which would be possible, even if the voltage supplied to the drive unit for driving the print head dropped, to avoid a lack of alignment in the positions of the characters, symbols, etc., printed by the print head moving in the normal direction and the reverse direction, thereby enabling the printed characters and symbols to be arranged in an orderly fashion.

SUMMARY OF THE INVENTION (1) Object of the Invention

This invention has been developed for the purpose of solving the aforesaid problem of the prior art. Accordingly, the invention has as its object the provision of a serial printer capable of printing characters, symbols, etc., in an orderly fashion with a predetermined spacing interval in spite of a voltage drop of the battery as the power source.

(2) Statement of the Invention

According to the invention, there is provided a serial printer having a print head movable in reciprocatory movement along a line on which characters, symbols, etc., are to be printed to print data on a printing sheet by performing printing in a normal direction from the beginning of the line or in the reverse direction from the end of the line, comprising a drive unit for moving the print head in reciprocatory movement, a printing control unit for causing the print head to perform a printing operation, means for judging whether printing of characters is performed in the normal direction or in the reverse direction, and sensor means for monitoring the level of a voltage supplied from a power source to the drive unit, wherein said printing control unit serves concurrently as correcting means which is capable of bringing the positions of characters printed when the print head moves in the normal direction into alignment with the positions of characters printed when the print head moves in the reverse direction by delaying, in response to the operation of the sensor means, the initiation of a printing operation performed at the least in either the normal direction and/or the reverse direction.

DESCRIPTION OF THE PREFERRED EMBODIMENT

Figure 1:
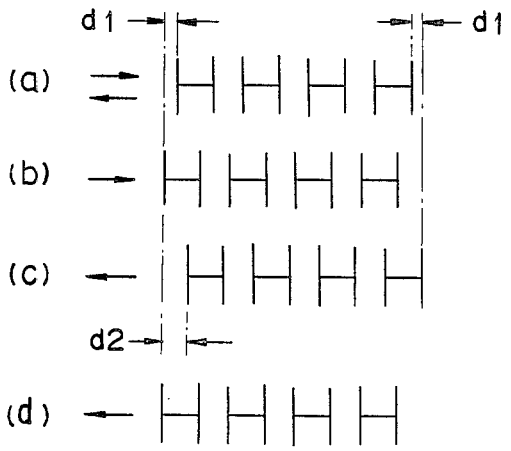
FIGS. 1(*a*) to 1(*d*) are views in explanation of the manner in which characters printed by a serial printer of the prior art when the voltage of its power source drops are located in positions which are out of alignment with each other.

Before describing a preferred embodiment of the invention in detail, the prior art will be outlined by referring to FIGS. 1(*a*) to 1(*d*) showing the manner in which the positions of characters printed when the print head moves in the normal direction and the reverse direction are out of alignment with each other.

When printing is performed in the normal direction at the time the voltage of the power sources is reduced, printing of characters is performed before the print head is moved rightwardly a predetermined distance as shown in FIG. 1(*b*), so that the positions of the characters printed are displaced leftwardly a distance $d_1$ from the positions of the characters printed in steady-state condition as shown in FIG. 1(*a*). Likewise, when printing is performed in the reverse direction at the time the voltage of the power source is reduced, printing of characters is performed before the print head is moved leftwardly the predetermined distance as shown in FIG. 1(*c*), so that the positions of the characters printed are displaced rightwardly the distance $d_1$ from the positions of the characters printed in steady-state condition. Thus, as can be clearly seen in FIGS. 1(*b*) and 1(*c*), the distance between the characters printed in the normal direction and the characters printed in the reverse direction, distance $d_2$, which is twice the distance $d_1$, has the result that the printed characters are out of alignment with each other.

Figure 2:
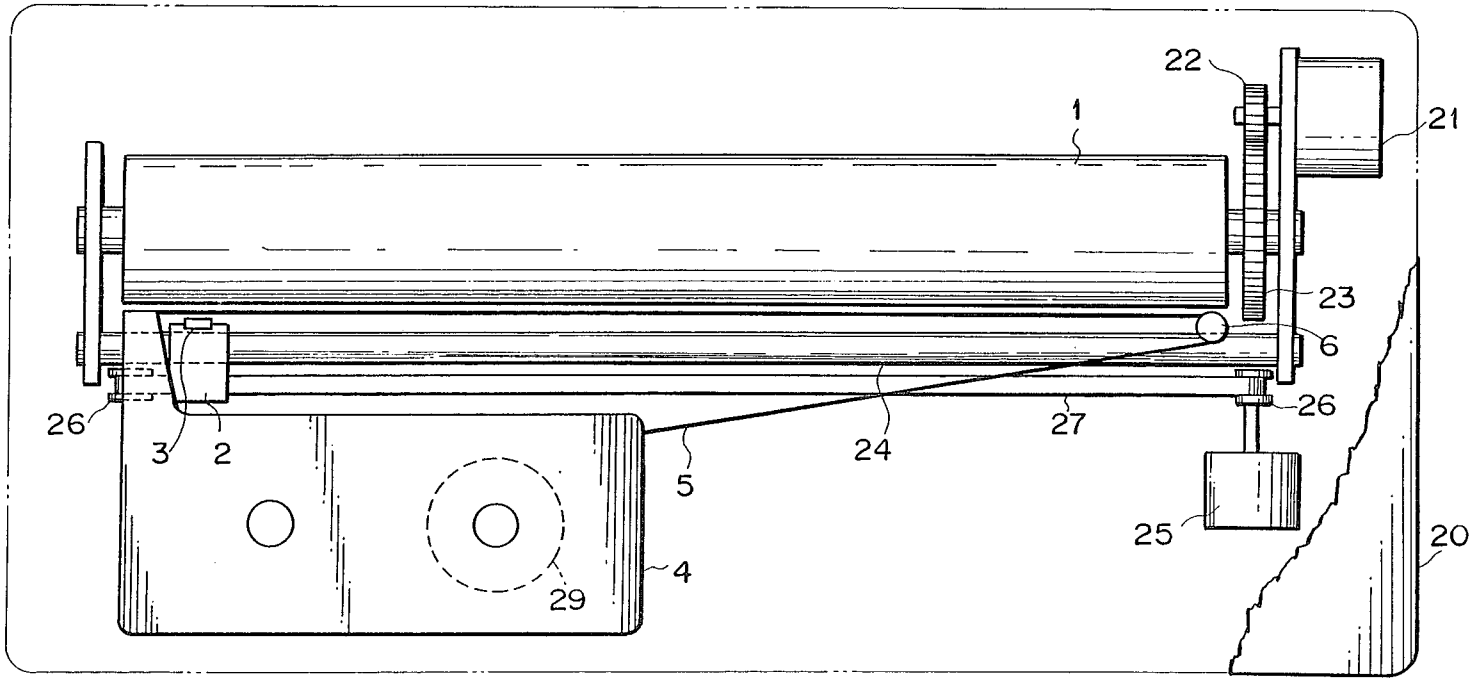
FIG. 2 is a plan view, with certain parts being broken away, of the serial printer comprising one embodiment of the invention.

The preferred embodiment of the invention will now be described by referring to FIG. 2 wherein the serial printer comprises a platen 1 supported by a frame 20 for rotation and a pulse motor 21 for rotating, through gears 22 and 23, the platen 1 in the normal and the reverse directions respectively to feed a printing sheet wound on the platen 1.

Disposed parallel to the platen 1 is a guide rod 24 which is secured to the frame 20 for supporting a carriage 2 for movement axially of the guide rod 24 along a printing line on the printing sheet on the platen 1. The carriage 2 supports a print head 3. Another pulse motor 25 is operative to drive the carriage 2 for reciprocatory sliding movement on the guide shaft 24 through a toothed belt trained over a pair of toothed pulleys 26 and secured at one portion thereof to the carriage 2.

A ribbon cassete 4 is mounted on the frame 20 at one end portion thereof lengthwise of the platen 1 and holds therein a printing ribbon 5 of a thermal transferprinting type with one portion thereof extending outwardly in loop form. A ribbon guide 6 is located at an opposite end portion of the frame 20 lengthwise of the platen 1 for the loop-like run of the printing ribbon 5 to be trained over it and to be guided to move along a printing line on the printing sheet on the platen 1 while being located between the platen 1 and the print head 3. Still another pulse motor 29 is mounted on the frame 20 and connected to a shaft, not shown, of a reel in the ribbon cassette 4 to take up a used portion of the printing ribbon 5 while causing an unused portion thereof to be fed out of the ribbon cassette 4. The print head 3 is moved between an operative position in which it is brought into contact with the printing sheet on the platen 1 through the unused portion of printing ribbon 5 and an inoperative position in which it is brought out of contact with the printing sheet by means of a solenoid 28 (see FIG. 3).

Figure 3:
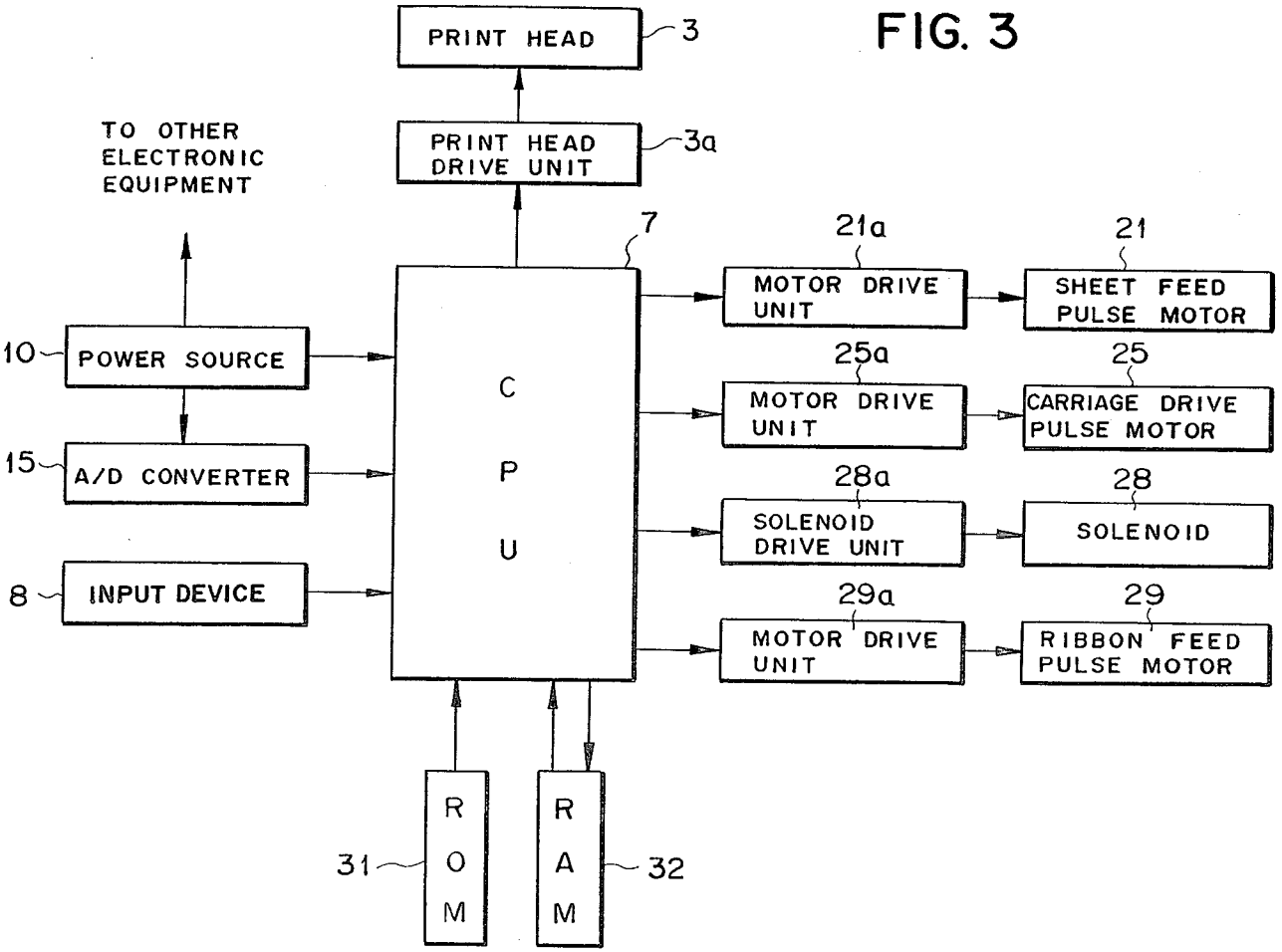
FIG. 3 is a block diagram of the control circuit of the serial printer shown in FIG. 2.

The control circuit of the embodiment of the serial printer in conformity with the invention will be described by referring to FIG. 3, wherein the pulse motors 21, 25 and 29 and solenoid 28 are connected through drive units 21*a*, 25*a*, 29*a* and 28*a*, respectively, to a central processing unit (CPU) 7. The print head 3 is connected through a print head drive unit 3*a* to the CPU 7. A readonly memory (ROM) 31 stores therein a program for controlling the operation of the serial printer, and print data and tab data are written in and retrieved from a random access memory (RAM) 32 as keys are actuated. A power source 10 which may be a battery, an analog-to-digital converter (A/D) 15 and an output device 8 including keys are connected to the CPU 7.

As a print signal is inputted from the input device 8 to the CPU 7, the latter produces operation signals to the drive unit 25*a* for driving the pulse motor 25 for driving the carriage 2 and the drive unit 3*a* for driving the print head 3 in accordance with the program stored in the ROM 31. This causes power to be supplied from a power source to the pulse motor 25 for driving the carriage 2 based on the operation signal from the CPU 7 to move the print head 3 together with the carriage 2 in a normal direction and in a reverse direction. The print head drive unit 3*a* supplies power from the power source to the print head 3 based on the operation signal from the CPU 7, to cause the print head 3 to perform a printing operation based on the print signal. This allows the print data to be printed on the print sheet on the platen 1 either in the normal direction from the beginning of the line of characters to be printed or in the reverse direction from the end of the line of characters to be printed.

Each time the printing operation of one line is performed, the CPU 7 outputs operation signals to the solenoid drive unit 28 and the drive unit 29*a* for driving the pulse motor 29 for feeding the printing ribbon 5, to bring the print head 3 into and out of contact with the printing sheet on the platen 1 and to feed the printing ribbon 5. The CPU 7 concurrently functions as means for judging whether the printing of characters taking place is in the normal direction or in the reverse direction and outputs an operation signal to the motor drive unit 21*a* for driving the pulse motor 21 so as to feed the print sheet by rotating the platen 1, upon completion of one line printing in the normal direction or in the reverse direction.

Meanwhile, the A/D converter 15 includes the sensor for monitoring the level of a voltage supplied from a power source 10 to the drive unit 25*a* for driving the pulse motor 25 for driving the carriage 2, and the A/D converter 15 converts the monitored voltage level into digital value conversion before outputting same to the CPU 7. When the printing of characters is performed in the reverse direction, the CPU 7 functions as correcting means for setting a corrected value for the time for initiating an operation by comparing the voltage level monitored by the A/D converter 15 with a reference value stored in the ROM 31 and delaying the time for initiating the operation of printing characters in the reverse direction based on the corrected value, so as to thereby bring the positions of the characters printed in the reverse direction into alignment with the positions of the characters printed in the normal direction.

The operation of delaying the time for initiating the operation of printing characters in the reverse direction based on the corrected value in conformity with the operation of printing characters in the normal direction will be described by referring to the flow charts shown in FIGS. 4 and 5.

Figure 4:
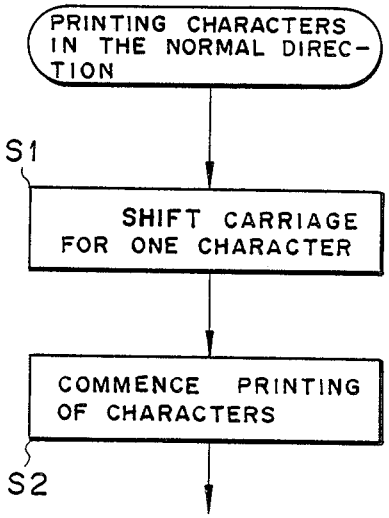
FIG. 4 is a flow chart in explanation of the steps to be followed prior to the initiation of a printing operation in the normal direction.

When the operation of printing characters in the normal direction is performed, the CPU 7 outputs an operation signal to the motor drive unit 25*a* for driving the pulse motor 25 for moving the carriage 2 in step $S_1$ upon receipt of a print signal from the output device 8, as shown in FIG. 4. This causes a voltage to be impressed from the power source which may be a battery on the drive unit 25*a*, so that the carriage 2 supporting the print head 3 is moved a distance corresponding to one character in the normal direction and shifted thrown up at a constant speed. Then, in step $S_2$, an operation signal is outputted from the CPU 7 to the drive unit 3*a* for the print head 3, to thereby commence the printing of characters performed by the print head 3. Therefore, if the voltage impressed on the drive unit 25*a* for driving the pulse motor 25 for moving the carriage 2 dropped due to a decrease in the electrical charge stored in the battery, for example, commencement of the movement of the print head 3 will be delayed by the reduction in the voltage in performing the printing of characters in the normal direction, with the result that the printing of characters will be performed before the print head 3 moves rightwardly a predetermined distance as shown in FIG. 1(*b*). The character printed at this time will, therefore, be displaced leftwardly from the character printed in the regular position shown in FIG. 1(*a*).

Figure 5:
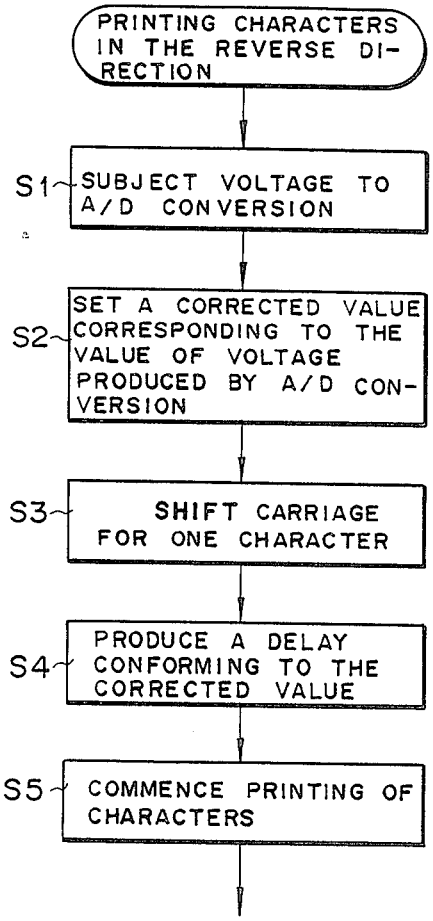
FIG. 5 is a flow chart in explanation of the steps to be followed prior to the initiation of a printing operation in the reverse direction.

Meanwhile, when printing of characters is performed in the reverse direction as shown n FIG. 5, the voltage level of the battery is monitored by the A/D converter 15 in step $S_1$ and the value of the voltage is outputted to the CPU 7 after a printing signal in inputted from the output device 8 to the CPU 7. Then, in step $S_2$, the CPU 7 sets a corrected value for the time for initiating the operation of printing characters based on the value of the voltage monitored by the A/D converter 15. Thereafter, in step $S_3$, the voltage is impressed on the drive unit 25*a* for driving the pulse motor 25 for moving the carriage 2 to move the carriage 2 supporting the print head 3 in the reverse direction a distance corresponding to one character. While moving in the reverse direction, the carriage 2 is shifted at a constant speed.

After the carriage 2 is moved, the CPU 7 provides for a delay corresponding to the corrected value for the time for initiating the operation of printing characters in step $S_4$ and outputs, in step $S_5$, an operation signal with a time lag corresponding to the delay in the drive unit 3*a* for driving the print head 3 to commence a printing operation by the print head 3. Thus, when the voltage level of the power source impressed on the drive unit 25*a* for driving the pulse motor 25 for starting the movement of the carriage 2 in the reverse direction is lower than the reference value, the time for initiating a printing operation by the print head 3 is delayed corresponding to the delay in the movement thereof. As a result, the printing operation performed by the print head 3 is initiated after it has moved rightwardly a predetermined distance as shown in FIG. 1(*d*), so that the characters printed by the print head 3 in the reverse direction are aligned with the characters printed by the print head 3 in the normal direction shown in FIG. 1(*b*).

While a preferred embodiment of the invention has been shown and described hereinabove, it is to be understood that the invention is not limited to the specific form of the embodiment, and that various changes and modifications may be made therein without departing from the scope of the invention. For example, the time for initiating a printing operation performed in the normal direction may be delayed to bring the characters printed in the normal direction into alignment with the characters printed in the reverse direction, or the times for initiating printing operation in the normal direction and the reverse direction may be both be delayed to bring the characters printed in both directions into alignment with each other.

From the foregoing description, it will be appreciated that the serial printer according to the invention is capable of bringing the characters printed in the normal direction and the reverse direction into alignment with each other without any displacement, even if the voltage of the power source supplied to the drive unit for driving the print head drops. This is conducive to the production of a printed copy of data of high quality which is free from non-uniformity of the printed characters.

What is claimed is:

1. A battery operated serial printer having a print head moveable in reciprocatory movement along a line upon which characters, symbols, and other print elements are to be printed to print data on a printing sheet by performing printing in a normal direction from the beginning of the line and in a reverse direction from the end of line, said printer comprising:

a drive unit for moving said print head in a reciprocatory movement;

a battery power source connected to said drive unit for powering said drive unit;

a printing control unit for causing said print head to perform a printing operation;

a voltage level sensing means operatively connected to said power source for determining the voltage level supplied by said power source to said drive unit when said printing operation is commenced;

memory means connected to said voltage level sensing means and storing therein a reference value corresponding to a sensed normal voltage level of said power source and a plurality of correcting values each corresponding to a sensed voltage level less than said normal voltage level; and, a control means for controlling said printing control unit, said drive unit, said voltage sensing means and said memory means so as to select one of said correcting values when a sensed voltage level is less than said normal voltage level and apply said correcting value to said printing control unit and said drive unit whereby to inhibit said printing control unit from initiating printing until said printing head comes into proper character alignment position of said normal or reverse printing.

2. The invention in accordance with claim 1 wherein said drive unit is controlled in open loop control by said control means.

3. The invention in accordance with claim 1 further comprising direction sensing means for determining if printing is being performed in said normal direction or in said reverse direction and for controlling said control means only when said printing direction is reverse.

* * * * *